US007850507B2

(12) United States Patent
Horta et al.

(10) Patent No.: US 7,850,507 B2
(45) Date of Patent: Dec. 14, 2010

(54) UNDERWIRE END PROTECTOR HAVING A FLEXIBLE ZONE AND UNDERWIRE ASSEMBLY INCORPORATING SAME

(75) Inventors: Joseph Horta, Yonkers, NY (US); Kurt Kopf, Woodside, NY (US)

(73) Assignee: S & S Industries, Inc., Yonkers, NY (US)

( * ) Notice: Subject to any disclaimer, the term of this patent is extended or adjusted under 35 U.S.C. 154(b) by 310 days.

(21) Appl. No.: 11/992,142

(22) PCT Filed: Sep. 18, 2006

(86) PCT No.: PCT/US2006/036567

§ 371 (c)(1),
(2), (4) Date: Mar. 14, 2008

(87) PCT Pub. No.: WO2007/035781

PCT Pub. Date: Mar. 29, 2007

(65) Prior Publication Data

US 2009/0156096 A1 Jun. 18, 2009

(51) Int. Cl.
*A41C 1/14* (2006.01)
*A41C 3/00* (2006.01)

(52) U.S. Cl. ..... 450/41; 450/45

(58) Field of Classification Search ..... 450/41, 450/45–48, 51, 52; 2/255–260, 260.1, 264, 2/261

See application file for complete search history.

(56) References Cited

U.S. PATENT DOCUMENTS 2,938,215 A * 5/1960 Schwartz ..... 2/257
3,562,802 A 2/1971 Avis
3,599,643 A 8/1971 Schwartz
3,605,753 A 9/1971 Schwartz
3,777,763 A 12/1973 Schwartz
4,133,316 A 1/1979 Schwartz
4,203,449 A 5/1980 Winzelberg
4,275,740 A 6/1981 Weston
4,285,113 A 8/1981 Rowell
4,770,650 A 9/1988 Rowell
4,777,668 A 10/1988 Weston
5,830,040 A 11/1998 Morgan
6,019,662 A 2/2000 Fildan
6,152,802 A 11/2000 Horta et al.
6,780,080 B2 8/2004 Horta et al.
6,857,933 B2 2/2005 Horta et al.

* cited by examiner

*Primary Examiner*—Gloria Hale
(74) *Attorney, Agent, or Firm*—Abelman, Franye & Schwab

(57) ABSTRACT

A protective device for an end portion of an underwire for a garment including a cushion tip having a proximal portion and a distal portion. The proximal portion has "an internal cavity extending over a portion of the length of the proximal portion and is dimensioned to receive the end of an underwire of similar cross-section. The distal end of the cushion tip extends from the proximal portion a distance beyond the cavity length and includes at least one portion of relatively reduced bending strength formed by reducing the cross-sectional area by way of a groove or grooves, or the like. The at least one groove provides a flexible region between the proximal and distal portions. The portion of relatively reduced bending strength can be provided by other known means such as molding the protective device with different materials of relatively different strengths.

28 Claims, 4 Drawing Sheets

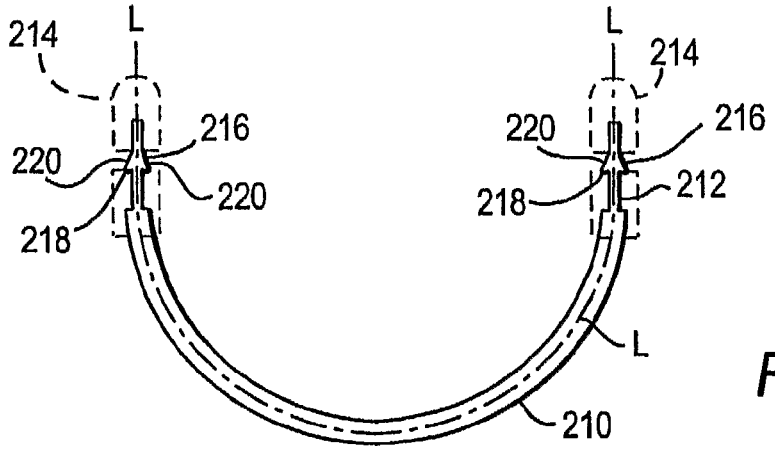
FIG. 8
FIG. 9
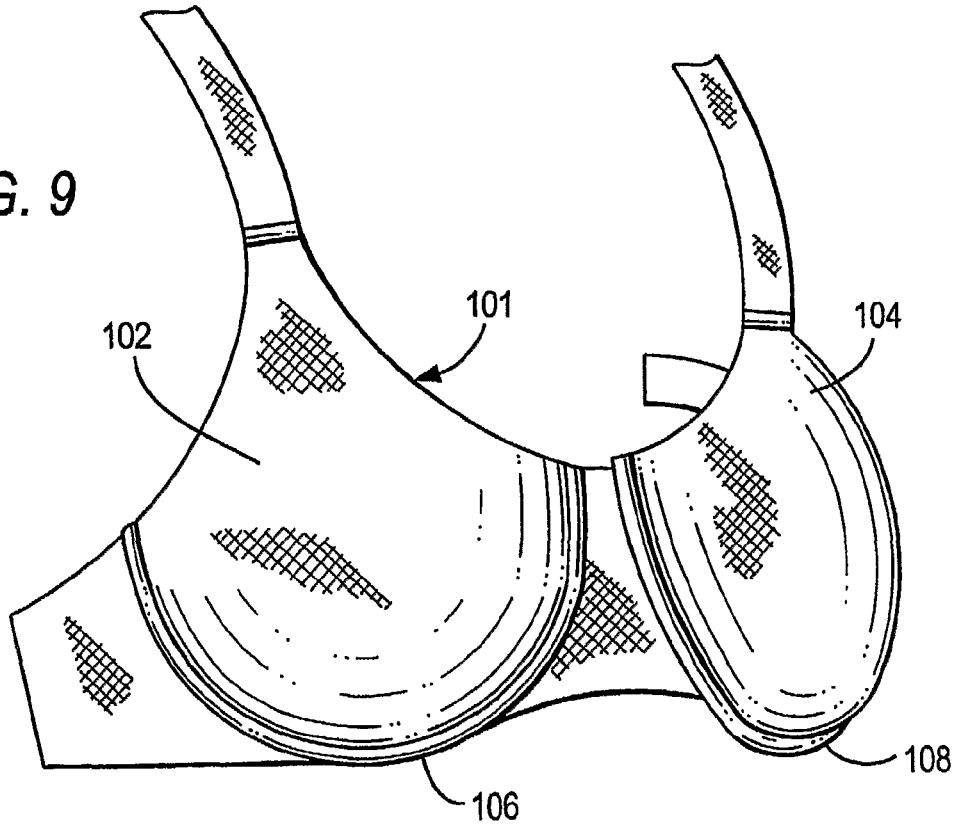
FIG. 10
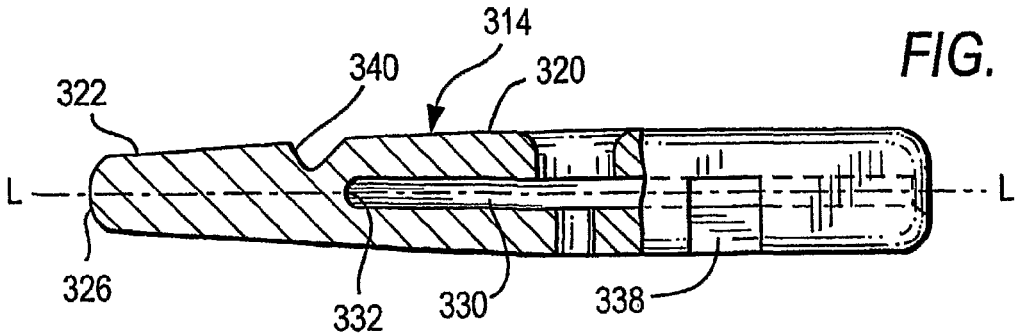

UNDERWIRE END PROTECTOR HAVING A FLEXIBLE ZONE AND UNDERWIRE ASSEMBLY INCORPORATING SAME

BACKGROUND OF THE INVENTION

1. Field of the Invention

This invention relates to underwires used in supporting garments. More specifically, the invention relates to underwire end protectors.

2. Description of the Related Art

Brassieres and similar supporting garments typically include an underwire in the form of a semi-rigid stiffening member of a generally arcuate U-shape that is positioned below the breast cup to provide increased support to the garment. The underwire is placed in an appropriately shaped fabric pocket or sleeve that extends from the central portion and along the lower and outside portions of the breast cup to a position at the wearer's side, under the arm. The resilient underwire of the prior art can be made of a metal, such as steel, having a rectangular, oval or other cross-section, or from polymeric materials in a variety of cross-sectional shapes.

As manufactured, the U-shaped underwire of the prior art has a length "L" defined by a longitudinal axis extending from one end to the other. The underwire also lies flat in an unstressed state, its longitudinal axis lying in a plane. The dimension of the underwire in this plane and perpendicular to the length is the width "W", and the dimension perpendicular to the plane is the depth "D". When fabricated from metal, the underwire will twist when subjected to a torque applied to its ends. A lateral force applied normal to the plane of the longitudinal axis at a point near one end will also produce a twisting or torsional movement of the underwire. As used herein, the term "lateral force" means a force applied in a direction that is normal to the longitudinal axis or plane of the underwire in its flat, unstressed condition.

When assembled in the supporting garment, the outer end or tip portion of the underwire is positioned in a soft fleshy area of the wearer. The ends of the underwire, one of which will generally be along the side of the breast proximate the wearer's arm, and the other of which will generally be at the cleavage portion of the breast, distal the wearer's arm, are stiff and rigid and typically include hard corners as manufactured. During movement, the rigid ends of the underwire, and other portions intermediate the ends, can press uncomfortably against or into the wearer at particularly sensitive portions of the wearer's body. This discomfort is most commonly experienced by wearers of larger cup sizes, i.e., individuals having a fleshy torso and those engaged in physical activity that includes stretching, turning and twisting of the torso.

One common practice for alleviating this discomfort is to provide an underwire end protector, and zones of flexibility in the underwire. A relatively soft auxiliary cushion tip of plastic or the like is attached at each end of the underwire. Such cushion tips and flexible underwires are described in U.S. Pat. Nos. 6,780,080, 5,830,040, 3,777,763, and 6,857,933, the disclosures of which are incorporated herein by reference and made a part of this application. These patents represent a number of successful efforts to provide greater comfort to the wearers of supporting garments constructed with underwires. The cushion tips disclosed in these patents protect the wearer from the ends of the underwires and have achieved commercial and wearer acceptance. While their presence has provided significant comfort to the wearer, they nevertheless are subject to improvement.

For example, when an underwire is subjected to repeated use and wear, the tip portion of the end protector is generally subjected to repeated cyclic stresses due at least in part to interactive contact with the body of the wearer. In rare instances, the tip of the end protector can potentially break off at a cross-section which exposes a portion of the metal underwire due to its reduced cross-sectional area and bending strength in the portion in which the arcuate underwire is contained. Should the tip of the end protector break away in this fashion, it may expose the tip of the metal underwire, potentially leading to tearing of the fabric sleeve and exposure of the underwire. Additionally, in limited instances, assembly of the underwire with the fabric sleeve can also cause somewhat adverse results by subjecting the cushion tips to limited amounts of stress.

As noted, underwire end protectors of the known type are generally fitted over the end portion of the underwire. The narrow sleeve into which the underwire is fitted is usually made from a soft plush fabric in order to cushion the feel of the underwire against the wearer's body. Because the sleeve is U-shaped to match the underwire, the underwire must be inserted in a curving motion and slid into and around the sleeve into position. Typically, the underwire is fed through the sleeve by manually grasping and pushing on the underwire or end protector. However, depending upon the configuration and dimensions, the underwire end protectors will sometimes catch onto the plushy fabric, particularly if the underwire has to be withdrawn at all in the process of being fitted into the sleeve.

The tip portion of the end protector may thus be occasionally subjected to stresses while the underwire is being routed through the sleeve, a condition which can also weaken the tip somewhat. As noted previously, should the tip portion of the underwire end protector break off, the U-shaped underwire, which often is made of metal, but may also be made of plastic or the like, can become exposed to the wearer and cause discomfort until it is discarded or replaced. One significant improvement in such end protectors is disclosed in commonly assigned U.S. Pat. No. 6,780,080 which relates to a narrow profile soft tip for underwire which makes assembly with the garment smoother and snag-free.

The present invention is related to an underwire end protector that may be used with supporting garments having casings or sleeves of all types. The end protector is particularly structured to protect a wearer from the ends of the underwire in the event that an end portion of the end protector is damaged or broken away for any reason.

SUMMARY OF THE INVENTION

Although the present invention is intended for use particularly with brassieres, as used herein, the term "supporting garments" is intended to include brassieres, corsets, swim suits peignoirs and other foundation garments that have breast-supporting cups.

The present invention is intended to provide an underwire having at least one end protector which improves upon the above-described known underwires and end protectors. In particular, the present invention is directed to an underwire end protector that may be used with relatively narrower garment casings or sleeves, and which will protect a wearer from the underwire in the event that the end of the end protector is damaged during wear, or weakened for any reason, including the insertion of the underwire into the casings or sleeves of supporting garments.

According to one embodiment, the invention is directed to a protective device for an end of an underwire for a garment.

Preferably a protective device is utilized to cover each opposing end of the underwire. The protective device, hereinafter referred to as a "cushion tip" or "soft tip" includes a proximal portion for receiving and covering an end of the underwire, and distal portion which extends longitudinally outward therefrom. That is, an end of the underwire is inserted into a generally elongated cavity formed in the proximal portion of the cushion tip, while the opposed distal portion of the cushion tip extends longitudinally from the end of the underwire to provide additional protection for the wearer of the garment.

The proximal portion has an internal cavity extending substantially over the length of the proximal portion and is dimensioned to receive the end of an underwire of similar cross-section. The distal portion of the end protector extends from a distance beyond the innermost end of the internal cavity and includes at least one groove or cutout oriented in a direction generally transverse to the channel. The at least one groove or cutout provides a flexible region between the proximal and distal portions of the cushion tip.

In preferred embodiment, the at least one groove includes a pair of diametrically opposed grooves, one on each side of the end protector. Such grooves are preferably V-shaped grooves, but can also be U-shaped grooves, rectangular shaped grooves, among other geometrically shaped grooves or cutouts. Alternatively, one or more slits can be formed in the walls of the distal portion to enable flexibility of the distal portion with respect to the proximal portion of the cushion tip.

The at least one groove establishes a weakest point in the wall of the cushion tip. During installation of the underwire into a sleeve of a garment (e.g., brassiere), if the garment maker grasps and pushes on the cushion tip, and the tip should break either during fabrication or subsequently during use by a wearer, the tip will break off at the weakest point, being substantially along the at least one groove or cutout. Thus, the distal end portion of the cushion tip can separate easily from the proximal end. As shown, the groove (or grooves) is positioned on the wall distal of the channel end, and a protective end portion of the proximal portion of the end protector will completely encase the end portion of the underwire so that it will not be exposed at the breakpoint (i.e., the proximal portion) of the cushion tip. Alternatively, it is conceivable that the weaker, or frangible portion, can be provided by using a different material of lesser bending strength in the molding process.

A protective device is disclosed for an end portion of a garment underwire, which comprises a protective tip defining a generally longitudinal axis and having a proximal portion and a distal portion connected thereto by a connecting portion having strength less than said proximal and distal portions, respectively, the proximal portion having an internal cavity dimensioned for reception of the underwire end portion for retaining the protective tip thereon, the innermost end of the internal cavity being located proximal of the connecting portion. Preferably, the proximal and distal portions have generally similar cross-sectional dimensions, and the connecting portion of less strength has a cross-sectional dimension less than that of the proximal and distal portions. The connecting portion comprises at least one groove extending generally transverse to the longitudinal axis, or alternatively, at least two opposed grooves extending generally transverse to the longitudinal axis.

The at least one groove may have a generally V-shaped cross-section, or a generally rectangular cross-section. The connecting portion may be defined by at least two opposed rectangular grooves extending generally transverse to the longitudinal axis, or it may include a plurality of adjacent grooves extending generally transverse to the longitudinal axis.

The connecting portion may include a plurality of opposed grooves on each side of the protective tip and extending generally transverse to said longitudinal axis. The proximal portion includes a bore extending generally transversely through a wall portion thereof to accommodate a member upstanding from the underwire end portion to retain the protective tip thereon.

A protective device for an end portion of an underwire for a garment is also disclosed, which comprises a protective tip having a proximal portion and opposed distal portion, the proximal portion having an internal cavity extending over a portion of the length of the proximal portion and dimensioned to receive the end portion of the underwire for retaining the tip thereon. The distal portion is connected to the proximal portion by a connecting portion having bending strength less than that of the proximal and distal portions respectively. The connecting portion is spaced distally from an innermost end of the internal cavity.

A soft tip end protector for a brassiere underwire is disclosed, which comprises a generally elongated soft tip member having a predetermined cross-sectional area, and a generally elongated inner cavity for reception of a tip portion of the underwire for mounting the soft tip member on the tip portion of the underwire. The innermost end of the cavity is closed to provide a limit stop for the underwire tip portion. The tip member having a portion of reduced cross-section which is spaced from said innermost end of said elongated inner cavity, Broadly stated, a protective soft tip for an underwire is disclosed, which comprises a generally elongated member having a predetermined cross-section and defining a generally elongated inner cavity having a closed innermost end for reception of an end portion of the underwire for mounting thereon. The elongated member includes a portion having a cross-section less than the first-mentioned predetermined cross-section and spaced from the innermost end of the inner cavity.

An underwire assembly is also disclosed, which comprises a generally arcuate member intended to be fitted into a sleeve of a brassiere, a protective soft tip positioned on at each end portion of the arcuate member, the protective soft tip comprising a generally elongated member having a predetermined cross-section and defining a generally elongated inner cavity having a closed innermost end. The underwire end portion is inserted into the inner cavity to support the protective soft tip thereon. At least one portion of the generally elongated member has a cross-section less than the first mentioned predetermined cross-section, and is spaced from the innermost end of the inner cavity such that in the event the elongated member is broken at the reduced cross section, the tip end of the arcuate member will not be exposed.

A supporting garment is also disclosed, comprising first and second breast cups, and first and second sleeves respectively positioned under the breast cups. An underwire assembly is fitted in each of the first and second sleeves, wherein each underwire assembly comprises a generally arcuate member, and a protective tip is positioned on at least one end portion of the arcuate member, the protective tip comprising a generally elongated member having a predetermined cross-section and defining a generally elongated inner cavity having a closed innermost end which provides a stop for the underwire end portion. The underwire end portion is inserted into the inner cavity to support the protective soft tip thereon. At least one portion of the generally elongated member has a cross-section less than the first mentioned predetermined cross-section, and is spaced from the innermost end of the inner cavity such that in the event the elongated member is broken at the reduced cross-section, the tip end of the arcuate member will not be exposed.

These and other features and advantages of the present invention will be apparent from the following detailed description of the preferred embodiments taken in conjunction with the following drawings, wherein like reference numerals denote like elements.

BRIEF DESCRIPTION OF THE DRAWINGS

Preferred embodiments of the invention are described hereinbelow with reference to the drawings, wherein:

FIG. 8 is a plan view of an underwire according to the present invention, showing in phantom lines, cushion tips according to the invention;

FIG. 9 is a perspective view of a supporting garment in the form of a brassiere, incorporating improved underwires constructed in accordance with the present invention;

FIG. 10 is a cross-sectional view of an alternative embodiment of the underwire end protector according to the invention;

FIG. 12 is a cross-sectional view of yet another embodiment of the underwire end protector according to the invention, showing in phantom lines a molding tab which is not part of the invention, but which can be used to handle the molded end protector before it is removed by grinding or the like.

Figure 1:
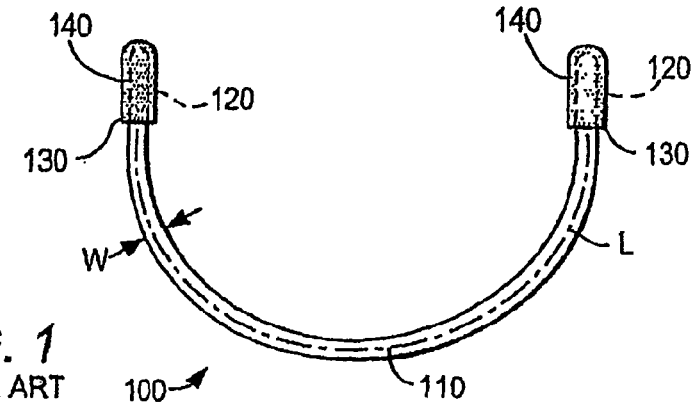
FIG. 1 PRIOR ART
FIG. 1 is a plan view of a typical prior art underwire assembly fitted with known cushion tips.

To facilitate understanding of the invention, the same reference numerals have been used, when appropriate, to designate the same or similar elements that are common to the FIGS. Further, unless stated otherwise, the drawings shown and discussed in the figures are not drawn to scale, but are shown for illustrative purposes only.

DETAILED DESCRIPTION OF THE PREFERRED EMBODIMENTS

In the description of the underwire end protector which follows, the tip end portion of the end protector is referred to as the "proximal portion" and the opposite end portion is referred to as the "distal portion" i.e, from the vantage point of the party installing the cushion tip onto the underwire, along longitudinal axis "L" shown in the FIGS.

Referring initially to FIG. 1, there is illustrated an embodiment of an underwire assembly of the prior art, designated generally by the reference numeral 100. The arcuate member 110 has a longitudinal axis "L" and a width "W" perpendicular thereto lying in the plane of curvature (i.e., the plane of the drawing). The width "W" of the arcuate member 110 taken along substantially the entire longitudinal axis is uniform. The opposed ends 120 of the underwire are fitted with cushion tips 140, sometimes referred to as "soft tips," as shown. Some departure from the uniform cross-section may appear at the ends 120 of the underwire in order to accommodate mounting of the tips 140. For example, it is known to provide one or more perforations at one or both ends of the arcuate member 110 for slidably or pivotally mounting the soft tip 140.

Once the tips 140 are disposed over the respective ends 120 of the underwire 100 and secured in place by appropriate means, the underwire assembly is complete. Thereafter, the assembled underwire is slid into or pushed through a sleeved formed in the supporting garment that is sized to comfortably receive and accommodate the underwire with the protective cushion tips. As noted, in the prior art, pushing or pulling on a tip such as 140 to draw the underwire through the sleeve can cause undesirable stresses on the tips that may weaken the ends of the tips to a point that they may eventually break. If the tips 140 should break while inserting the underwire 100 into the garment, then the broken end can snag on the fabric of the sleeve into which the underwire assembly 100 is fitted, causing the difficulties in assembly as discussed above. Moreover, if the tips 140 should break at a later time while the garment is being worn, then the exposed wire at the broken end of the protective end can become uncomfortable or in rare cases, cause minor discomfort.

Figure 2:
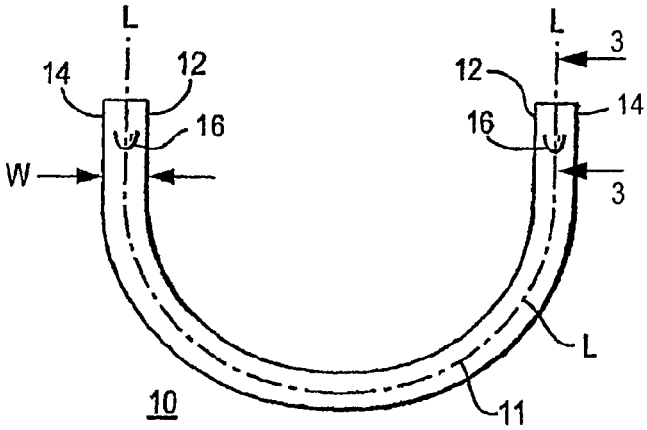
FIG. 2 is a plan view of a bare underwire suitable for use with a preferred embodiment of the present invention.
Figure 3:
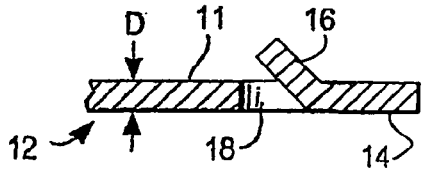
FIG. 3 is a cross-sectional view of one end portion of the underwire of FIG. 2 taken along line 3-3 of FIG. 2.

Referring now to FIG. 2, there is depicted one embodiment of the improved underwire in accordance with the present invention, designated generally by the reference numeral 10. The underwire 10 includes an arcuate member 11 having a longitudinal axis "L" and a width "W" perpendicular thereto lying in the plane of curvature. The dimension perpendicular to the plane is the depth "D" as shown in FIG. 3. Arcuate member 11 may be made of metal, plastic or any other suitable material known in the art.

Figure 4:
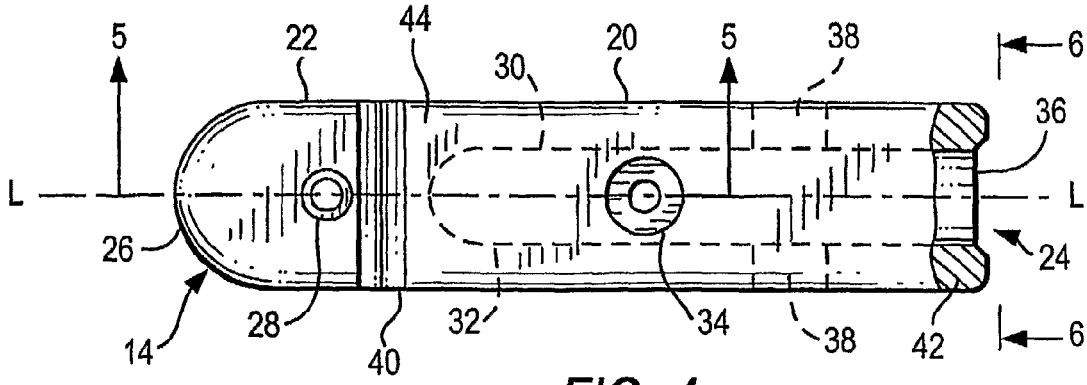
FIG. 4 is a top plan view of an improved end protector for an underwire in accordance with a preferred embodiment of the present invention.

In one embodiment shown in FIGS. 2, 3 and 4, a protruding retaining member 16 is provided as shown in a plane extending at a generally acute angle to the plane of the underwire. The protruding retaining member 16 secures the cushion tip 14 shown in FIG. 4, onto the end 12 of the underwire 10 by entry into aperture 34 when the cushion tip 14 is slid onto the end portion of the bare underwire.

Referring again to FIG. 3, in one embodiment, the protruding retaining member 16 is formed by punching out a small portion 16 of the underwire 10 proximate the end 12. The resulting protruding retaining member 16 is bent upwardly out of the plane of the underwire and a punched hole 18 is formed in the underwire beneath the protruding retaining member 16. Retaining member 16 in the configuration shown is particularly applicable for underwires of relatively lesser width. With underwires of greater width, the end portions can be configured to include notched or cutout portions on the sides of the end portion to form various shaped side surfaces for securing the cushion tips 14 thereto.

One preferred embodiment of such underwire configuration is shown in FIG. 8 wherein underwire 210 includes end portions 212 having a configuration somewhat like a "Christmas Tree" as shown, to receive cushion tips 214 shown in phantom lines for convenience of illustration. In particular, the angled sides 216 of the end portions 212 form ridges 218 which are configured to engage apertures 220 in the sides of the cushion tips 214 as shown, to retain the tips on the underwire. Other known means for attaching the cushion tips to the underwires are contemplated, including the use of adhesives, or any other configurational interlocking techniques.

Referring to FIGS. 4-8, the cushion tips 14 are formed generally in the shape of a generally elongated cap that fits over the underwire end portions 12. The tips 14 are fabricated from a soft relatively semi-flexible moldable material, such as plastic, rubber, synthetic resin, or polyethylene. Each cushion tip 14 has a proximal portion 20 including a central cavity in the form of channel 30 (see FIG. 5) with a central opening 36 surrounded by a wall 42, as shown. A distal portion 22 of the cushion tip 14 has a rounded end 26 and presents a continuous continued cover for the tip portion of the arcuate member 11.

Referring again to FIGS. 4-7, grooves 40 are formed on each side of wall 42 and define a boundary between the proximal portion 20 and a distal portion 22 of the tip 14. As discussed in greater detail below, grooves 40 are positioned beyond the inner end of channel 30 which receives the underwire 10. Grooves 40 provide flexibility for the distal portion 22 with respect to the proximal portion 20 of cushion tip 14, and therefore establish a relatively weakened cross-section of flexibility for the cushion tip 14, thus making the distal portion 22 of the cushion tip 14 frangible—or capable of being broken first should the cushion tip 14 be subjected to excessive bending stress or fatigue. During installation of the underwire 10 into the sleeve of the garment, if the installer pulls on the cushion tip 14, should the tip break during assembly, it will break off at the weakest point, i.e., along grooves 40. Similarly, should the tip break while being worn, it will break at the same location, i.e., at the weakest point along grooves 40.

Thus, the distal end 22 of the cushion tip 14 can separate from the proximal end 20. As shown, grooves 40 are positioned on the wall 42 beyond the channel end 32, such that a residual protective end portion 44 of the proximal portion 20 completely encases the underwire 10 so that it will not be exposed at the breakpoint (i.e., the proximal portion) of the cushion tip 14. Alternatively, one groove 40 may be provided as shown in FIG. 10. Whether one groove 40 or more than one groove 40 is used, they may also have alternative shapes.

Figure 5:
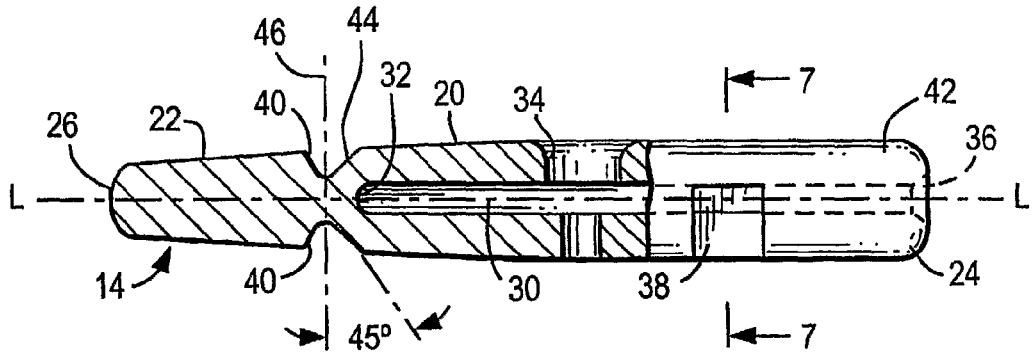
FIG. 5 is a partial cross-sectional view of the end protector of FIG. 4, taken along section line 5-5 of FIG. 4.

As noted, one or more grooves 40 may be provided. However, two grooves 40 as shown in FIG. 5 for example, are preferred. Grooves 40 are intended to function as (or similar to) the well known living hinge which is generally formed by a thin section of molded plastic that connects two plastic segments to keep them together and allow them to flex relative to each other. Materials used in living hinges are usually flexible plastic such as polypropylene, polyethylene or other known copolymers, which can flex up to, or in excess of one million cycles without failure. The molecules of the plastic are usually oriented along the hinge line for the hinge to have acceptable life. In any event, after sufficient number of cycles the frangible tip can break off.

Referring again to the FIGS., and in particular to FIGS. 4-7, the proximal end 20 and distal end 22 collectively form an elongated cushion tip 14. Referring to FIG. 5 from right to left, the channel 30 begins at an orifice 36 formed in the proximal tip portion 24 (FIG. 6) and extends a distance within the proximal end 20 and terminates at a location just proximal of the groove 40. That is, the channel 30 extends only through a portion of the proximal portion 20, leaving a predetermined residual, or protective end portion 44 between the innermost end 32 of channel 30 and the groove 40. The residual portion 44 is intentionally made solid for added strength.

Figure 6:
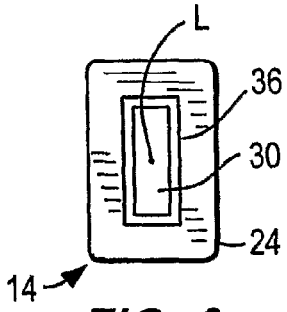
FIG. 6 is an end view of the end protector of FIG. 4, taken along section line 6-6 of FIG. 4.
Figure 7:
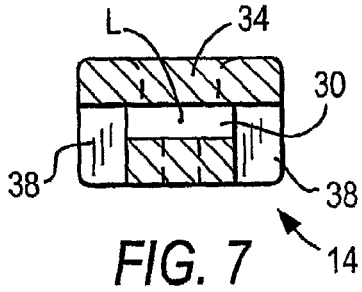
FIG. 7 is a cross-sectional view of the end protector of FIG. 5, taken along section line 7-7 of FIG. 5.

The size and shape of the channel (or cavity) 30 is substantially rectangular in cross-section as shown in FIGS. 6 and 7 to accommodate the rectangular shape of the underwire 10. However, one skilled in the art will appreciate that the channel 30 can have any cross-sectional shape suitable for accommodating a similarly shaped underwire. For example, the channel 30 can have a round shape to accommodate an underwire of circular cross-section.

Referring again to FIGS. 4-7, the proximal portion 20 further includes an aperture, or bore 34 formed (preferably during the molding process) between the front portion 24 and channel end 32 and traverses perpendicularly through to channel 30 as shown. The bore 34 is positioned to interact with the channel 30, and is sized to accommodate the protruding retaining member 16 of the underwire 10 (see FIGS. 2 and 3). The protruding retaining member 16 extends a distance opposite the direction of insertion into the channel 30, and is angled to permit passage of the underwire end 12 into the channel 30 during installation onto the underwire.

When the end 12 of the underwire 10 is slidably engaged into the channel 30 of the cushion tip 14, the wire 10 is pushed until the protruding "knock-out" retaining member 16 is aligned with bore 34 and springs up into bore 34. That is, the protruding retaining member 16 essentially snap-fits into the channel 30 when the "knock-out" retaining member 16 is aligned with the bore 34, and secures the cushion tip 14 onto the end 12 of the underwire 10.

Referring to FIGS. 5 and 8, the proximal portion 20 of cushion tip 14 may further also include mounting cutouts 38 formed on each side as shown, in the wall 42 between the bore 34 and proximal portion tip 24. In FIG. 8, these mounting cutouts are shown as mounting cutouts 220 which are each formed to receive a lip 216, for example, as shown, to secure the cushion tip to the underwire. As noted, the aperture 34 is intended to receive a portion 16 from thinner wires as shown in FIG. 3, to attach the cushion tip to the wire in a manner somewhat similar to that used with thicker wires as shown in FIG. 8, i.e., by snap engagement.

Referring again to FIG. 5, in one preferred embodiment, a pair of grooves 40 is formed on opposing sides of the cushion tip 14. Each groove is preferably V-shaped as shown, such that the vertex of each V-shaped groove is diametrically opposed to the other, on each side of axis line 46, (shown in phantom lines). Preferably, the opposing edges of each groove are orthogonal (i.e., each spaced about 45° apart with respect to axis line 46). Further, the vertex of each groove 40 is curved, for example, having a relatively small radius of the order of about less than 0.040 inches, and preferably about 0.020 inches.

A person skilled in the art will appreciate that the V-shaped groove 40 is not considered as being limiting, and can include any shape (e.g., semi-circular) suitable for providing a weak point in the walls of the cushion tip 14. Further, the angle between the sides of the V-shaped groove is not limited to 90°, and therefore can be an acute angle as well, without departing from the invention. Alternatively, one or more cuts or slices may be formed in the wall 42 instead of the grooves. A cut or slice provides a weak point in the wall of the cushion tip 14. Essentially, a critical feature of the invention resides in the reduced cross-section area of the elongated comfort just distal of the innermost end of the inner channel 30 which receives the end portion of the underwire for mounting purposes.

Figure 11:
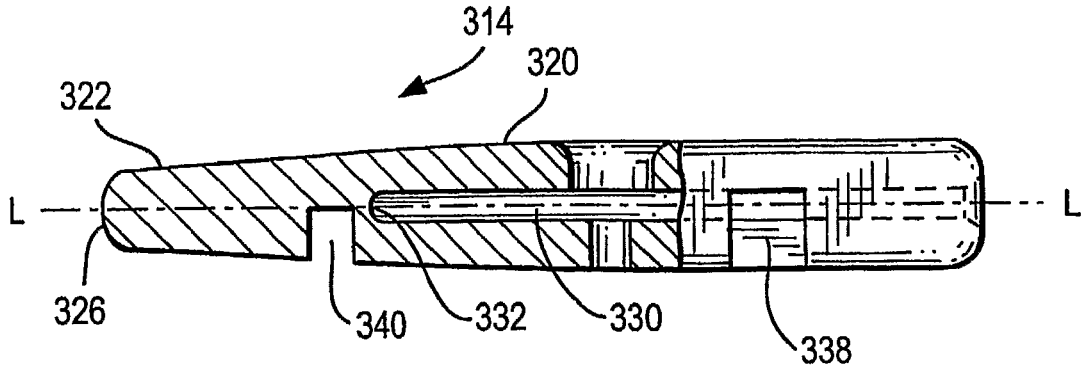
FIG. 11 is a cross-sectional view of an another alternative embodiment of the underwire end protector according to the invention.
Figure 12:
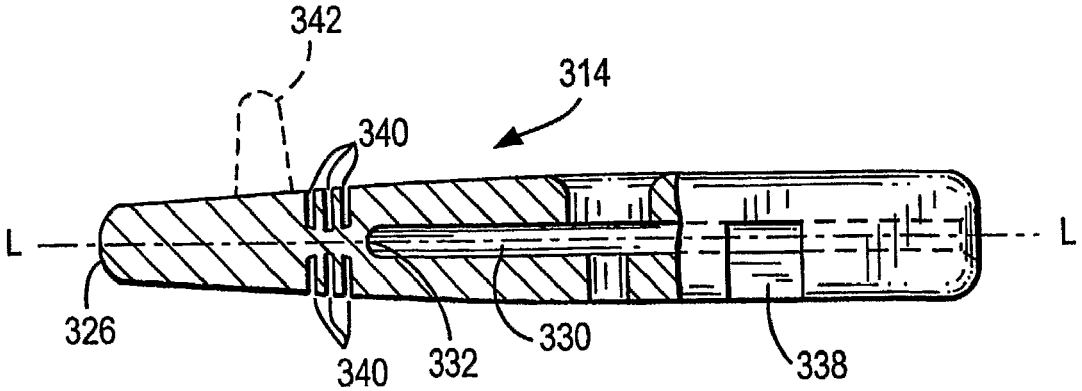

FIGS. 10-12 depict various illustrative alternative embodiments of the cushion tip according to the invention, showing alternative techniques for providing a cross-section of increased frangibility relative to the rest of the cushion tip.

FIG. 10 is an elevational view, partially in cross-section, of an alternative embodiment of the present cushion tip 314, similar to FIG. 5, but incorporating a single V-shaped groove 340 to render the end most tip portion of the cushion tip relatively frangible.

FIG. 11 is an elevational view, partially in cross-section, of another embodiment of the present cushion tip 314, similar to FIG. 5, but incorporating a single rectangular-shaped groove 340 to render the tip portion of the cushion tip frangible.

FIG. 12 is an elevational view, partially in cross-section, of yet another alternative embodiment of the present cushion tip 314, similar to FIG. 5, but incorporating a plurality of slits 340 to render the tip (or distal) portion of the cushion tip relatively frangible. Although three slits are shown in FIG. 12, one slit is sufficient to provide the requisite weakening of the cross-section of the distal portion of the cushion tip 314.

FIG. 12 shows in phantom lines, for example, a generally perpendicular molded extension (or flash) which is formed during the molding process and which is not part of the present invention. This pin member 342 may be used to handle the comfort tip after molding, but is later removed.

Although the groove or cutout 340 shown in the various embodiments are illustratively discussed as being U-shaped, V-shaped, square or rectangular shaped, as well as being in the form of one or more slits, one skilled in the art will appreciate that other geometric shaped weakening techniques can be utilized, such as linear, curved or combinations thereof. Further, one skilled in the art will appreciate that a single groove or multiple grooves can be implemented on a single side of the cushion tip, or on opposing or adjacent sides, to provide a frangible cushion tip. It is essential that the bending strength of the weakened portion is made less than in the remaining portions, and this can be accomplished by various geometric or structural techniques. It is conceivable that different materials of relative different bending strengths can be blended together in the molding process.

The cushion tip 14 may be mounted on the end portion of the underwire in any effective way as for example is shown in FIG. 8. For example, a press set fitting may be made by fitting the cushion tip tightly over the end of the arcuate member, or the cushion tip could be molded directly onto the end. In another method, the cushion tip can be attached by sonic sealing, wherein ultrasonic wave technology is used to seal the plastic of the cushion tip to the metal (or plastic) of the arcuate member. Any other appropriate method may be used, such as adhesives or the like, depending upon the application.

The tips may be made of a soft material, such as a soft plastic or any suitable polymeric material, preferably moldable, so as to cover the metal of the arcuate underwire at the end portions. The tips can be fixed or movably mounted and can be configured and fitted or applied to the ends of the underwire in accordance with any of the materials and methods now known and utilized in accordance with any of the materials and methods now known and utilized in the prior art, as disclosed above or that may be developed in the future.

FIG. 9 is a view of a supporting garment 101 having breast cups 102, 104 with corresponding sleeves 106, 108 underneath. A respective underwire (not illustrated) in accordance with the present invention has been fitted into each sleeve 106, 108. The novel cushion tips (not illustrated) on the underwires may be used with casings or sleeves of any size and type in the garment, and at the same time prevents snagging of the fabric by the underwires in the event the distal end inadvertently breaks off during insertion into the sleeves. Moreover, the cushion tip of the present invention helps protect a wearer from the underwire in the event that the end of the cushion tip subsequently breaks off during insertion into the sleeves or during use.

While the disclosed structure and apparatus have been particularly shown and described with respect to the preferred embodiments, it is understood by those skilled in the art that various modifications in form and detail may be made therein without departing from the scope and spirit of the invention. Accordingly, modifications such as those suggested above, but not limited thereto are to be considered within the scope of the invention, which is to be determined by reference to the appended claims.

We claim:

1. A protective device for a tip end portion of a brassiere underwire, which comprises a protective tip defining a generally longitudinal axis and having orthogonal widthwise and thickness dimensions generally respectively transverse to said longitudinal axis, said protective tip having a proximal portion and a distal portion connected thereto by a connecting portion, said connecting portion having a portion of lesser thickness than either of said proximal and distal portions, said portion of lesser thickness extending across the entire width of said protective tip, such that the breaking strength of said portion of lesser thickness is less than the breaking strength of either of said proximal and distal portions, said proximal portion of said protective tip defining a generally longitudinal internal cavity dimensioned for reception of the underwire tip end portion for retaining said protective tip thereon, the distalmost end of said internal cavity being located proximal of said connecting portion.

2. The protective device according to claim 1, wherein said proximal and distal portions have generally similar cross-sectional dimensions.

3. The protective device according to claim 2, wherein said connecting portion comprises at least one groove extending generally transverse to said longitudinal axis.

4. The protective device according to claim 3, wherein said connecting portion comprises at least two opposed grooves extending generally transverse to said longitudinal axis, one of said grooves being on one side of said protective tip, and the other of said grooves being on the other side of said protective tip, both of said grooves extending over the width of said protective tip.

5. The protective device according to claim 3, wherein said at least one groove has a generally V-shaped cross-section.

6. The protective device according to claim 4, wherein each of said opposed grooves has a generally V-shaped cross-section.

7. The protective device according to claim 3, wherein said at least one groove has a generally rectangular cross-section.

8. The protective device according to claim 7, wherein said connecting portion is defined by at least two opposed grooves of generally rectangular cross-section extending generally transverse to said longitudinal axis.

9. The protective device according to claim 3, wherein said connecting portion is comprised of a plurality of adjacent grooves extending generally transverse to said longitudinal axis on one side of said protective tip.

10. The protective device according to claim 9, wherein said connecting portion is comprised of a plurality of opposed grooves on each side of said protective tip and extending generally transverse to said longitudinal axis.

11. The protective device according to claim 1, wherein said proximal portion includes at least one aperture extending generally transversely through a wall portion thereof to receive a member upstanding from said underwire end portion to securely retain said protective tip thereon.

12. A protective device for a tip end portion of an underwire for a garment, which comprises a protective tip having a proximal portion and an opposed distal portion, said protective tip defining a generally longitudinal axis and having orthogonal widthwise and thickness dimensions generally transverse to said longitudinal axis, said protective tip having a proximal portion defining a generally longitudinal internal cavity extending over at least a portion of the length of said proximal portion and having a closed distalmost end, said internal cavity being dimensioned to receive the end portion of the underwire for retaining said protective tip thereon, said distal portion being connected to said proximal portion by a connecting portion having breaking strength less than the breaking strength of said proximal and distal portions respectively, said connecting portion being spaced distally from said distalmost end of said internal cavity and extending across the entire width of said tip.

13. The protective device of claim 1, further comprising at least one aperture extending through a wall of said proximal portion and intersecting said internal cavity, said aperture being dimensioned and positioned to accommodate a protruding member extending generally outwardly from said end portion of said underwire.

14. The protective device of claim 1, wherein said proximal portion is of substantially generally rectangular cross-section.

15. The protective device of claim 1, wherein said internal cavity is of substantially rectangular cross-section for reception of an end portion of an underwire of similar cross-section.

16. The protective device of claim 1, wherein said connecting portion of relatively reduced breaking strength includes at least one transverse groove.

17. The protective device of claim 16, wherein said connecting portion of relatively reduced breaking strength comprises at least two opposed transverse grooves, one on each side of said connecting portion.

18. The protective device of claim 16, wherein said at least one groove is of substantially rectangular cross section.

19. The protective device of claim 16, wherein said at least one groove is of substantially square cross section.

20. The protective device of claim 16, wherein said at least one groove comprises at least one generally transverse slit.

21. The protective device of claim 1, wherein said at least one groove comprises a plurality of generally transverse slits in adjacent relation to each other.

22. The protective device of claim 1, wherein said internal cavity extends through a portion of said proximal portion to a closed distalmost end, the remaining portion between said closed distalmost end and said connecting portion defining a protective portion between said cavity and said connecting portion for the tip end portion of said underwire.

23. The protective device of claim 1, wherein said protective portion of said proximal portion completely encases the tip end portion of the underwire so that the tip end portion will not be exposed in the event said distal portion of said protective tip becomes separated from said proximal portion.

24. A soft tip end protector for a brassiere underwire, which comprises:

a) a generally elongated soft tip member defining a generally longitudinal axis and having a predetermined cross-sectional area, said soft tip member having orthogonal widthwise and thickness dimensions generally respectively transverse to said longitudinal axis; and b) a generally longitudinal elongated internal cavity for reception of a tip end portion of the underwire for mounting said soft tip member on the tip end portion of the underwire, the distalmost end of said cavity being closed to provide a limit stop for the underwire tip end portion; and c) said soft tip member having a portion of reduced cross-section which is spaced distally from said distalmost end of said elongated inner cavity, and which extends across the entire width of said soft tip member, said portion of reduced cross-section having a predetermined breaking strength less said remaining portions of said soft tip member.

25. An underwire assembly, which comprises:

a) a brassiere arcuate underwire member intended to be fitted into a sleeve of a brassiere; and b) a protective device for the tip end portion of the arcuate underwire member, including a protective tip defining a generally longitudinal axis and having orthogonal widthwise and thickness dimensions generally respectively transverse to said longitudinal axis, said protective tip having a proximal portion and a distal portion connected thereto by a connecting portion, said connecting portion having a portion of lesser thickness than either of said proximal and distal portions, said portion of lesser thickness extending across the entire width of said protective tip, such that the breaking strength of said portion of lesser thickness is less than the breaking strength of either of said proximal and distal portions, said proximal portion of said protective tip having an internal cavity having a distalmost end, and being dimensioned for reception of the tip end portion of said arcuate underwire member for retaining said protective tip thereon, the distalmost end of said internal cavity being located proximal of said connecting portion.

26. The underwire assembly of claim 25, wherein one of each of said protective soft tips is positioned on each respective tip end portion of said underwire.

27. A supporting garment, comprising:

a) first and second breast cups;

b) first and second underwire sleeves respectively positioned under said breast cups;

c) a generally arcuate brassiere underwire assembly fitted in each of said first and second sleeves, wherein each said underwire assembly comprises:

d) a generally arcuate brassiere underwire; and e) a protective device positioned on each tip end portion of each said brassiere underwires, which comprises a protective tip defining a generally longitudinal axis and having orthogonal widthwise and thickness dimensions generally respectively transverse to said longitudinal axis, said protective tip having a proximal portion and a distal portion connected thereto by a connecting portion, said connecting portion having a portion of lesser thickness than either of said proximal and distal portions, said portion of lesser thickness extending across the entire width of said protective tip, such that the breaking strength of said portion of lesser thickness is less than the breaking strength of either of said proximal and distal portions, said proximal portion of said protective tip having a generally central longitudinally extending internal cavity dimensioned for reception of the underwire tip end portion for retaining said protective tip thereon, the distalmost end of said internal cavity being closed and being located proximal of said connecting portion.

28. A protective device for an end portion of a brassiere underwire, which comprises a protective tip defining a generally longitudinal axis and having orthogonal widthwise and thickness dimensions generally respectively transverse to said longitudinal axis, said protective tip having a proximal portion and a distal portion connected thereto by a connecting portion, said connecting portion being of lesser thickness than either of said proximal and distal portions, said portion of lesser thickness extending across the entire width of said protective tip and being defined by a pair of opposed generally V-shaped grooves extending across the entire width of said protective tip, each said V-shaped groove having a generally arcuate shaped base, such that the breaking strength of said portion of lesser thickness is less than either of said proximal and distal portions, said proximal portion of said protective tip having an internal generally central longitudinally extending cavity dimensioned for reception of the underwire tip end portion for retaining said protective tip thereon, the distalmost end of said internal cavity being located proximal of said connecting portion, said proximal portion further having means for reception of a retaining member from the underwire tip end portion for securely retaining said protective tip in position on the tip end portion of the underwire.

* * * * *